US006456264B1

(12) United States Patent
Kang et al.

(10) Patent No.: US 6,456,264 B1
(45) Date of Patent: Sep. 24, 2002

(54) METHOD OF DRIVING PLASMA DISPLAY PANEL WITH AUTOMATIC POWER CONTROL FUNCTION

(75) Inventors: Kyoung-ho Kang, Asan; Jeong-duk Ryeom, Cheonan, both of (KR)

(73) Assignee: Samsung SDI Co., LTD, Kyungki-do (KR)

( * ) Notice: Subject to any disclaimer, the term of this patent is extended or adjusted under 35 U.S.C. 154(b) by 203 days.

(21) Appl. No.: 09/597,980

(22) Filed: Jun. 20, 2000

(30) Foreign Application Priority Data

Jun. 28, 1999 (KR) ..... 99-24745

(51) Int. Cl.[7] ..... G09G 3/28

(52) U.S. Cl. ..... 345/63; 345/60; 345/61; 345/62; 345/63; 345/64; 345/65; 345/66; 345/67; 345/68; 345/69; 345/70; 345/71; 345/72; 345/204; 315/169.1; 315/169.2; 315/169.4

(58) Field of Search ..... 345/60–72, 63, 345/204; 315/169.1, 169.4, 169.2

(56) References Cited

U.S. PATENT DOCUMENTS 5,943,032 A * 8/1999 Nagaoka et al. ..... 345/63
6,034,482 A * 3/2000 Kanazawa et al. ..... 315/169.4
6,124,849 A * 9/2000 Ito et al. ..... 345/204
6,198,476 B1 * 3/2001 Hong et al. ..... 345/204
6,292,159 B1 * 9/2001 Someya et al. ..... 345/60
6,317,105 B1 * 11/2001 Eo et al. ..... 345/68
6,320,560 B1 * 11/2001 Sasaki et al. ..... 345/60
6,326,736 B1 * 12/2001 Kang et al. ..... 315/169.4

FOREIGN PATENT DOCUMENTS

| | | |
|---|---|---|
| EP | 0 841 652 | 5/1998 |
| EP | 0 888 004 | 12/1998 |
| JP | 7-210113 | 8/1995 |

* cited by examiner

*Primary Examiner*—Richard Hjerpe
*Assistant Examiner*—Jennifer T. Nguyen
(74) *Attorney, Agent, or Firm*—Leydig Voit & Mayer, Ltd.

(57) ABSTRACT

In an address-while-display (AWD) driving method in which addressing and sustaining are simultaneously performed, a plasma display panel (PDP) is driven with an automatic power control function for reducing power consumption when there are lots of ON pixels over the entire PDP, that is, the brightness of the screen of the PDP is higher than a predetermined level. In the PDP driving method, in order to suppress power consumption for maintaining a bright state of the screen, discharge sustain pulses at respective sub-fields for implementing gray scale display of each frame are invalidated using erase pulses in a constant ratio for each sub-field, while all the video signals applied in the form of the AWD driving waveforms are continuously applied to the respective frame periods in which all the video signals are displayed without interruption, that is, irrespective of whether discharge is performed. Thus, while attaining an improvement in the luminance by applying many discharge sustain pulses based on the AWD driving method, the power consumption at high luminance is automatically reduced.

16 Claims, 14 Drawing Sheets

METHOD OF DRIVING PLASMA DISPLAY PANEL WITH AUTOMATIC POWER CONTROL FUNCTION

BACKGROUND OF THE INVENTION

1. Field of the Invention

The present invention relates to a method for driving a plasma display panel (PDP), and more particularly, to a method for driving a PDP with an automatic power control (APC) function for solving the problem of power shortage caused to a power source in a state where there are lots of light-on pixels in the PDP, that is, in a state where the brightness of the screen of the PDP is higher than a reference level, in an address-while-display (AWD) driving method in which addressing and sustaining are simultaneously active, and an apparatus thereof.

2. Description of the Related Art

A PDP is a display device for restoring image data input as an electrical signal with a plurality of discharge tubes arranged in a matrix to selectively emit light. PDPs are largely classified into direct current (DC) type PDPs and alternating current (AC) type PDPs according to whether the polarity of the voltage applied for sustaining a discharge changes or not over time.

FIG. 1 shows the basic structure of a general AC face discharge PDP. Referring to FIG. 1, a discharge space 15 is formed between a front glass substrate 11 and a rear glass substrate 17. In the AC face discharge PDP, a discharge sustaining electrode 12 is covered by a dielectric layer 13 so as to be electrically isolated from the discharge space 15. In this case, a discharge is sustained by the well-known wall charge effect. The above-described face discharge PDP includes two parallel discharge sustaining electrodes 12 on the front substrate 11 and an address electrode 16 on the rear substrate 17 and orthogonal to the discharge sustaining electrodes 12. According to this structure, an address discharge in which a pixel is selected occurs between the address electrode 16 and the discharge sustaining electrodes 12, and then a sustained discharge in which a video signal is displayed occurs between the two discharge sustaining electrodes 12, that is, a common (X) electrode 12*a* and a scanning (Y) electrode 12*b*.

FIG. 2 is an exploded perspective view schematic illustrating a generally used AC three-electrode face discharge PDP, in which an address electrode 16 and a pair of discharge sustaining electrodes 12*a* and 12*b* perpendicular to the address electrode 16 are installed in each discharge space 15 which is divided by partitions 18 on a rear substrate 17. The partitions 18 block space charges and ultraviolet rays produced during a discharge to thus prevent cross talk from being generated at neighboring pixels as well as forming the discharge spaces 15. In order for a PDP to operate as a color display device, fluorescent material layers 19 made of a fluorescent material excited by the ultraviolet rays produced during discharge and producing red (R), green (G) and blue (B) visible light for displaying R, G and B colors, are repeatedly arranged in the discharge space 15 in order, thereby displaying R, G and B colors.

In order for a fluorescent-material-coated PDP to be capable of operating as a color video display device, a gray scale display must be utilized. Currently, a gray scale display method in which a picture of one frame is divided into a plurality of sub-fields driven in a time-division manner is widely used.

FIG. 3 shows a gray scale display method in a general AC PDP. As shown in FIG. 3, in the gray scale display method of a general AC PDP, a picture of one frame is divided into a plurality of sub-fields each consisting of address periods and sustained discharge periods. Here, a 6-bit gray scale implementation method, for example, is explained. A picture of a frame is temporally divided into six sub-fields and 64 ($=2^6$) gray scales are displayed. Each sub-field consists of address periods A1–A6 and sustained discharge periods S1–S6. Gray scales are displayed using a principle in which the comparative lengths of the sustained discharge periods are expressed visually in the brightness ratio. In other words, since the lengths of the sustained discharge periods S1 to S6 of the first sub-field (SF1) to the sixth sub-field (SF6) comply with a ratio of 1:2:4:8:16:32, altogether, 64 types of sustained discharge periods, that is, 0, 1(1T), 2(2T), 3(1T+2T), 4(4T), 5(1T+4T), 6(2T+4T), 7(1T+2T+4T), 8(8T), 9(1T+8T), 10(2T+8T), 11(3T+8T), 12(4T+8T), 13(1T+4T+8T), 14(2T+4T+8T), 15(1T+2T+4T+8T), 16(16T), 17(1T+16T), 18(2T+16T), . . . , 62(2T+4T+8T+16T+32T) and 63(1T+2T+4T+8T+16T+32T) are constituted, thereby displaying 64 gray scale levels. For example, in order to display a gray scale level of 6 at an arbitrary pixel, only the second sub-field (2T) and the third sub-field (4T) have to be addressed. Also, in order to display a gray scale level of 15, all of the first through fourth sub-fields have to be addressed.

FIG. 4 is a layout diagram of electrodes of an AC face discharge PDP constructed for implementation of the gray scale display method shown in FIG. 3. Here, among the discharge sustaining electrodes 12 consisting of paired horizontal electrodes, the electrodes connected in common are common electrodes (X-electrodes) 12*a* and the other side electrodes are scanning electrodes (Y-electrodes) 12*b*. The common electrodes (X-electrodes) 12*a* are all connected in common and a voltage signal having the same waveform, including a discharge sustain pulse, is applied thereto. Thus, a scanning signal of the discharge sustaining electrodes 12 is applied to the scanning electrodes, that is, the Y-electrodes 12*b* so that addressing is done between the Y-electrodes 12*b* and the address electrodes 6, and the discharge sustain pulse is applied between the Y-electrodes 12*b* and the X-electrodes 12*a* so that a display discharge is sustained. Waveforms of the driving signals applied to the respective electrodes connected as above are shown in FIG. 5.

FIG. 5 is a diagram showing the waveforms of driving signals of a generally used AC PDP, in which a picture display is implemented by an address/display separation (ADS) driving method. In FIG. 5, reference mark A denotes a driving signal applied to address electrodes, reference mark X denotes a driving signal applied to the common electrodes (to be also referred to as X-electrodes) 12*a*, and reference marks Y1 through Y480 denote driving signals applied to the respective Y-electrodes 12*b*. During a total erase period A11 a total erase pulse 22*a* is applied to the common (X) electrodes 12*a* for an accurate gray scale display to cause a strong discharge, thereby erasing wall charges generated by a previous discharge to promote the operation of the next sub-field (step 1). Next, during a total write period A12 and a total erase period A13, in order to reduce an address pulse voltage 21, a total write pulse 23 is applied to the Y-electrodes 12*b* and a total erase pulse 22*b* is applied to the X-electrodes 12*a* to cause a total write discharge and a total erase discharge, respectively, thereby controlling the amount of wall charges accumulated in the discharge space 15 (steps 2 and 3). Then, during an address period A14, data converted into an electrical signal is written on a selected location on the whole screen of the PDP by a selective discharge using the address pulse (data pulse) 21 and a write pulse 24 between the address electrode 16 and the scanning electrode 12*b* intersecting each other (step 4). Next, during a sustained discharge period S1, a display discharge, which is caused by continuously applying the discharge sustain pulse 25, is sustained for a given period of time, for the purpose of displaying picture data on the screen.

As shown, as the number of scanning lines increases, the time required for a write operation increases and the number of sub-fields increases so that the time allocated to the sustain discharge is reduced. Thus, a panel having a higher resolution has a lesser overall luminance. That is, for a high-resolution display, luminance degradation cannot be avoided.

FIG. 6 is a timing diagram illustrating an address-while-display (AWD) driving method. As shown in FIG. 6, erasing, writing and sustaining are performed at each sub-field while sustaining is being performed at another line or group. This can be done during the time between the application of successive discharge sustain pulses. Application of an erase pulse is also done in the same manner. The AWD driving method has an advantage in that it can attain a high luminance display. However, according to this method, many switching elements are necessary, the circuit for implementation of this method is complex and a stable discharge is hard to achieve. Also, much power is necessary for maintaining the brightness of the screen. Thus, a large power supply stage must be designed, which entails, however, the problem of an increase in size and cost. In particular, if a still-picture state is maintained for some time, like in a monitor, the service life of a PDP may be shortened. Thus, appropriate measures against the service life reduction problem must be taken.

According to the conventional ADS driving method, since the respective sub-fields are separate, the power shortage problem can be simply solved by stopping the application of discharge sustain pulses to the sub-fields during an automatic power control (APC) operation. In other words, while a discharge sustaining operation is performed over the entire screen, there is a way to reduce the number of sustained discharges at a ratio in each sub-field by outputting all the sustain pulses allocated to the sub-field and setting erase and reset periods at the end of the sub-field. At this time, the erase and reset periods invalidate the sustain pulses following an erase pulse in each sub-field so that the sustained discharges due to the invalidated sustain pulse is not generated.

However, according to the conventional AWD driving method in which a discharge sustain pulse is continuously applied, discharge sustain pulses of different sub-fields are applied to different lines. Thus, the application of discharge sustain pulses cannot be stopped at discretion.

SUMMARY OF THE INVENTION

To solve the above problems, it is a first object of the present invention to provide a method for driving a plasma display panel (PDP) by which automatic power control (APC) is allowed by discontinuing discharge by applying an erase pulse during the course of a sustained discharge.

It is a second object of the present invention to provide an apparatus for driving a plasma display panel (PDP) by which automatic power control (APC) is allowed by discontinuing discharge by applying an erase pulse during the course of a sustained discharge.

Accordingly, to achieve the above object, there is provided a method for driving a plasma display panel (PDP) with an automatic power control function, the PDP having discharge sustaining electrodes consisting of pairs of scanning lines and common lines, and address electrodes arranged orthogonally to the discharge sustaining electrodes, the respective electrodes being driven by an address-while-display (AWD) driving method in which addressing and sustaining discharge for expressing gray scale levels by sub-fields each consisting of an erase period, an address period and a sustained discharge period, are simultaneously performed at the scanning lines not in a time-division manner, to display a video signal of each frame on the PDP, the method comprising the step of applying erase pulses for invalidating some of discharge sustain pulses applied during the sustained discharge periods corresponding to the respective sub-fields so as not to cause a sustained discharge, at predetermined timing points during the sustained discharge periods of the respective sub-fields.

In the present invention, there is further provided the step of, before applying the erase pulses at predetermined timing points of the sustained discharge periods, determining application timing points of the erase pulses by obtaining an invalidation ratio of discharge sustain pulses applied to the respective sub-fields by detecting the power consumed at a power source stage for driving the PDP when the luminance is at the maximum peak.

Also, in the present invention, erase pulses having the opposite polarity to the discharge sustain pulses applied to the common lines may be applied to the common lines immediately after application of discharge sustain pulses applied to the common lines and have widths narrower than those of the discharge sustain pulses. Otherwise, erase pulses may be formed by reducing the width of one of the discharge sustain pulses applied to the scanning lines by a width corresponding to a predetermined period so as to be narrower than that of the discharge sustain pulses, by applying voltages lower than those of the discharge sustain pulses applied to the common lines, to the scanning lines in synchronization with the discharge sustain pulses applied to the common lines, or by applying pulse voltages having the opposite polarity to the discharge sustain pulses applied to the scanning lines, in synchronization with the discharge sustain pulses applied to the common lines.

Also, the voltage of each erase pulse is preferably greater than or equal to the difference between a discharge starting voltage and the voltage of each of the discharge sustain pulses applied to the common lines. Preferably, the application timing point of the erase pulse during the sustained discharge period is determined by a constant time ratio to be proportional to the periods of the respective sub-fields.

According to another aspect of the present invention, there is provided a method for driving a plasma display panel (PDP) with an automatic power control function, the PDP having discharge sustaining electrodes consisting of pairs of scanning lines and common lines, and address electrodes arranged orthogonally to the discharge sustaining electrodes, the respective electrodes being driven by an address-while-display (AWD) driving method in which addressing and sustaining discharge for expressing gray scale levels by sub-fields each consisting of an erase period, an address period and a sustained discharge period, are simultaneously performed at the scanning lines, not in a time-division manner, to display a video signal of each frame on the PDP, the method comprising the step of changing the application timing points of the erase pulses into predetermined timing points during the sustained discharge periods of the respective sub-fields, and applying the erase pulses during the sustained discharge periods, the erase pulses being applied for invalidating some of discharge sustain pulses applied during the sustained discharge periods corresponding to the respective sub-fields so as not to cause a sustained discharge.

In the present invention, there is further provided the step of, before changing the application timing points of the erase pulses and applying the same, determining the application timing points of the erase pulses during the sustained discharge periods of the respective sub-fields by obtaining an invalidation ratio of discharge sustain pulses applied to the respective sub-fields by detecting the power consumed at a power source stage for driving the PDP when the luminance is at the maximum peak.

Preferably, the erase pulses having the same polarity to the discharge sustain pulses applied to the scanning lines are applied to the scanning lines immediately after the application of discharge sustain pulses applied to the common lines and have widths narrower than those of the discharge sustain pulses.

Also, in the present invention, the erase pulses having the opposite polarity to the discharge sustain pulses applied to the common lines may be applied to the common lines immediately after the application of discharge sustain pulses applied to the common lines, and have widths narrower than those of the discharge sustain pulses. Otherwise, the erase pulses may be formed by reducing the width of one of the discharge sustain pulses applied to the scanning lines by a width corresponding to a predetermined period so as to be narrower than that of the discharge sustain pulses, by applying voltages lower than those of the discharge sustain pulses applied to the common lines to the scanning lines in synchronization with the discharge sustain pulses applied to the common lines, or by applying pulse voltages having the opposite polarity to the discharge sustain pulses applied to the scanning lines, in synchronization with the discharge sustain pulses applied to the common lines.

Here, the voltage of each erase pulse is preferably greater than or equal to the difference between a discharge starting voltage and the voltage of each of the discharge sustain pulses applied to the common lines. Also, the timing point of applying the erase pulse during the sustained discharge period may be determined by a constant time ratio to be proportional to the periods of the respective sub-fields.

To achieve the second object of the present invention, there is provided an apparatus for driving a plasma display panel (PDP) with an automatic power control function, the PDP having discharge sustaining electrodes consisting of pairs of scanning lines and common lines, and address electrodes arranged orthogonally to the discharge sustaining electrodes, the respective electrodes being driven by an address-while-display (AWD) driving method in which addressing and sustaining discharge for expressing gray scale levels by sub-fields each consisting of an erase period, an address period and a sustained discharge period, are simultaneously performed at the scanning lines, not in a time-division manner, to display a video signal of each frame on the PDP, the apparatus including a detection block for detecting data for the determination of timing points of applying erase pulses during sustained discharge periods of the respective sub-fields, the erase pulses being applied for invalidating some of discharge sustain pulses applied during the sustained discharge periods corresponding to the respective sub-fields, so as not to cause a sustained discharge, a logic block for determining application positions of the erase pulses by the data detected from the detection block, and blocks of driving scanning lines, common lines and address electrodes, for applying the erase pulses according to the logic determined by the logic blocks.

Alternatively, the present invention provides an apparatus for driving a plasma display panel (PDP) with an automatic power control function, the PDP having discharge sustaining electrodes consisting of pairs of scanning lines and common lines, and address electrodes arranged orthogonally to the discharge sustaining electrodes, the respective electrodes being driven by an address-while-display (AWD) driving method in which addressing and sustaining discharge for expressing gray scale levels by sub-fields, each consisting of an erase period, an address period and a sustained discharge period, are simultaneously performed at the scanning lines, not in a time-division manner, to display a video signal of each frame on the PDP, the apparatus including a detection block for detecting data for determination of changed timing points of applying erases pulses and applying the same during sustained discharge periods of the respective sub-fields, the erase pulses being applied for invalidating some of discharge sustain pulses applied during the sustained discharge periods corresponding to the respective sub-fields so as not to cause a sustained discharge, a logic block for determining changed application positions of the erase pulses by the data detected from the detection block, and blocks of driving scanning lines, common lines and address electrodes, for applying the erase pulses according to the logic determined by the logic blocks.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

A method and apparatus for driving a plasma display panel having an automatic power control (APC) function according to the present invention will now be described in detail with reference to the accompanying drawings.

In general, a PDP consumes a large amount of power. Thus, in the case where the bright state of a screen is continued for some time, in order to reduce power consumption, the overall brightness of the screen is lowered. There are two typical methods of lowering the screen brightness. First, all input signals are detected and then, if the signals have lots of light-on data, the weights of the data are changed to lower the brightness. Second, the overall brightness of the panel is lowered by adjusting the lighting number at the respective sub-fields. In the former case, luminance reduction can be realized by signal processing. However, in this case, the panel has a reduced capacity to display gradation, which results in deterioration in gray scale expression on the screen. The PDP driving method according to the present invention utilizes a method of suppressing power consumption by adjusting the lighting numbers allocated to the respective sub-fields while avoiding deterioration in gray scale expression on the screen, as in the latter case.

Figure 1:
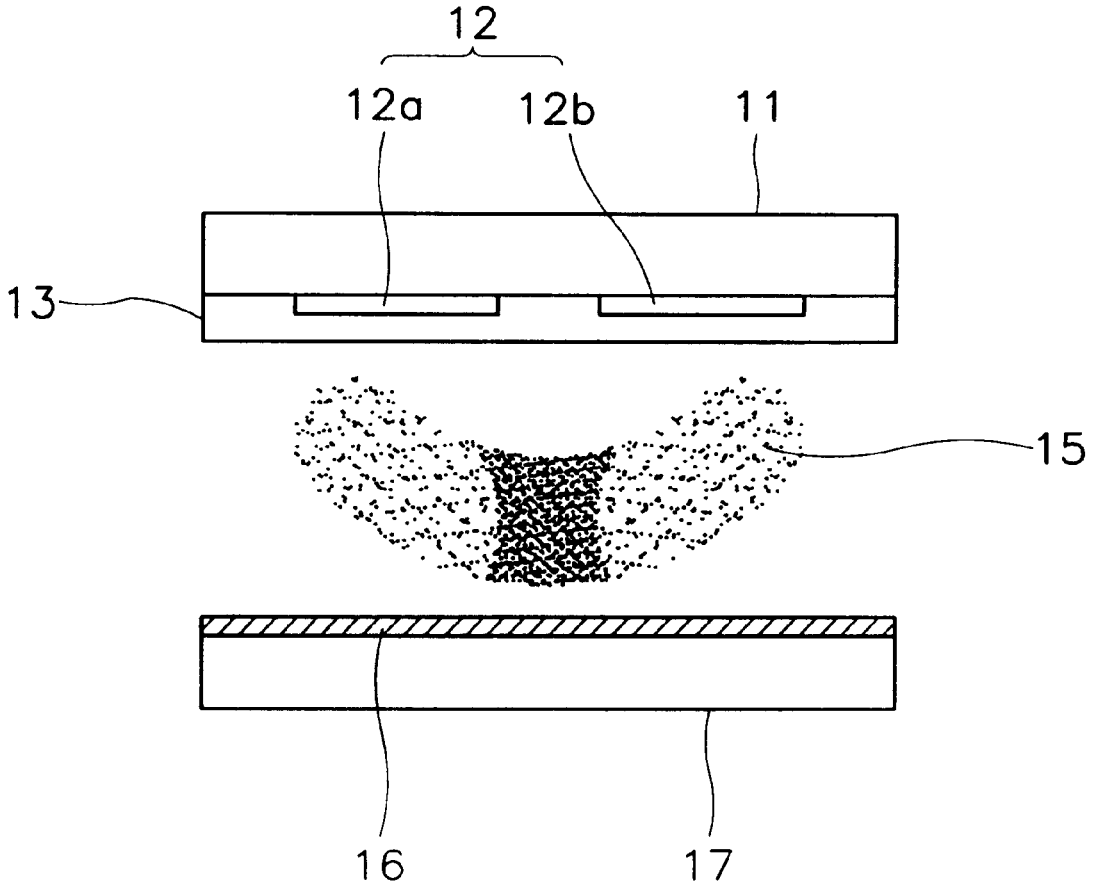
FIG. 1 (PRIOR ART)
FIG. 1 is a sectional view illustrating the basic structure of a general alternating-current (AC) face discharge plasma display panel (PDP)
Figure 2:
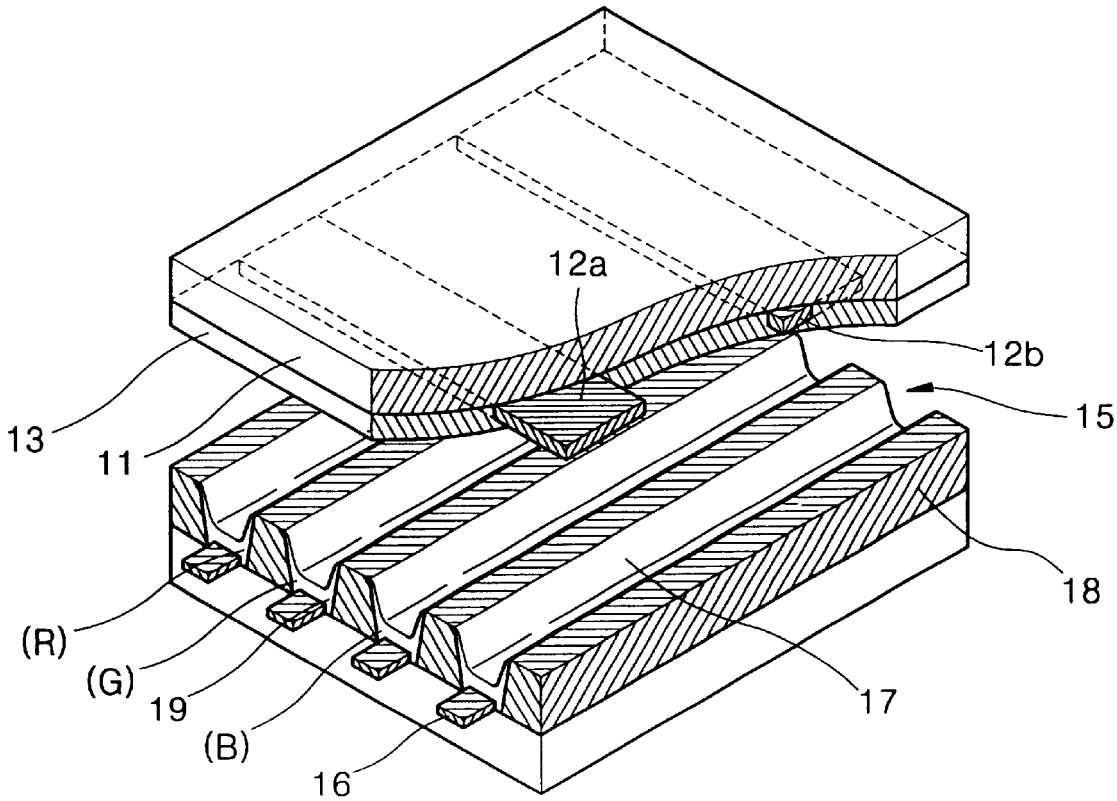
FIG. 2 (PRIOR ART)
FIG. 2 is an exploded perspective view schematically illustrating the AC three-electrode face discharge PDP shown in FIG. 1.
Figure 3:
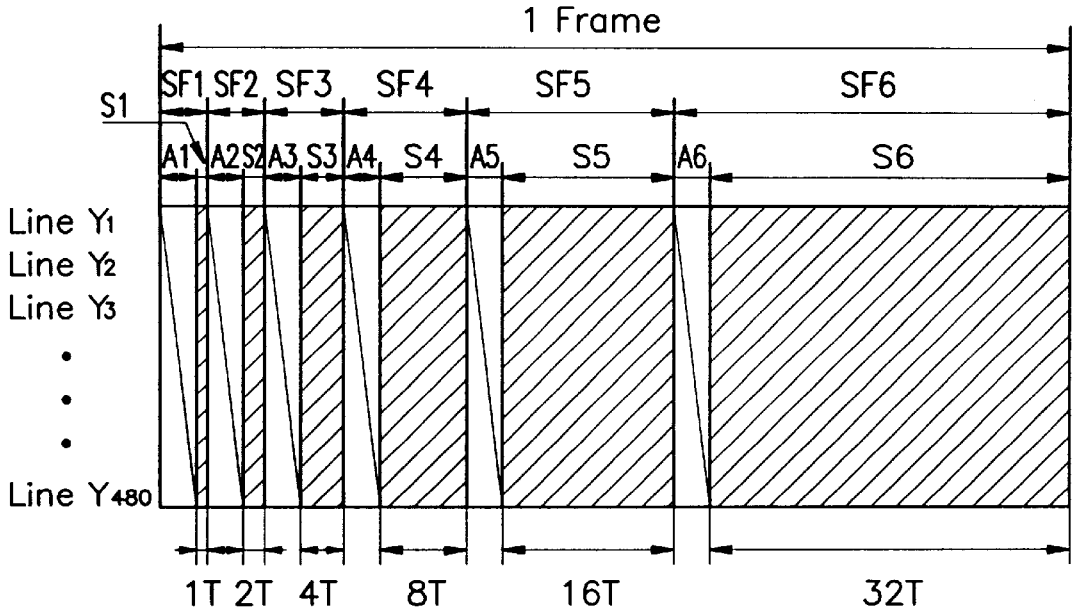
FIG. 3 (PRIOR ART)
FIG. 3 illustrates a gray scale display method of the AC three-electrode face discharge PDP shown in FIG. 2.
Figure 4:
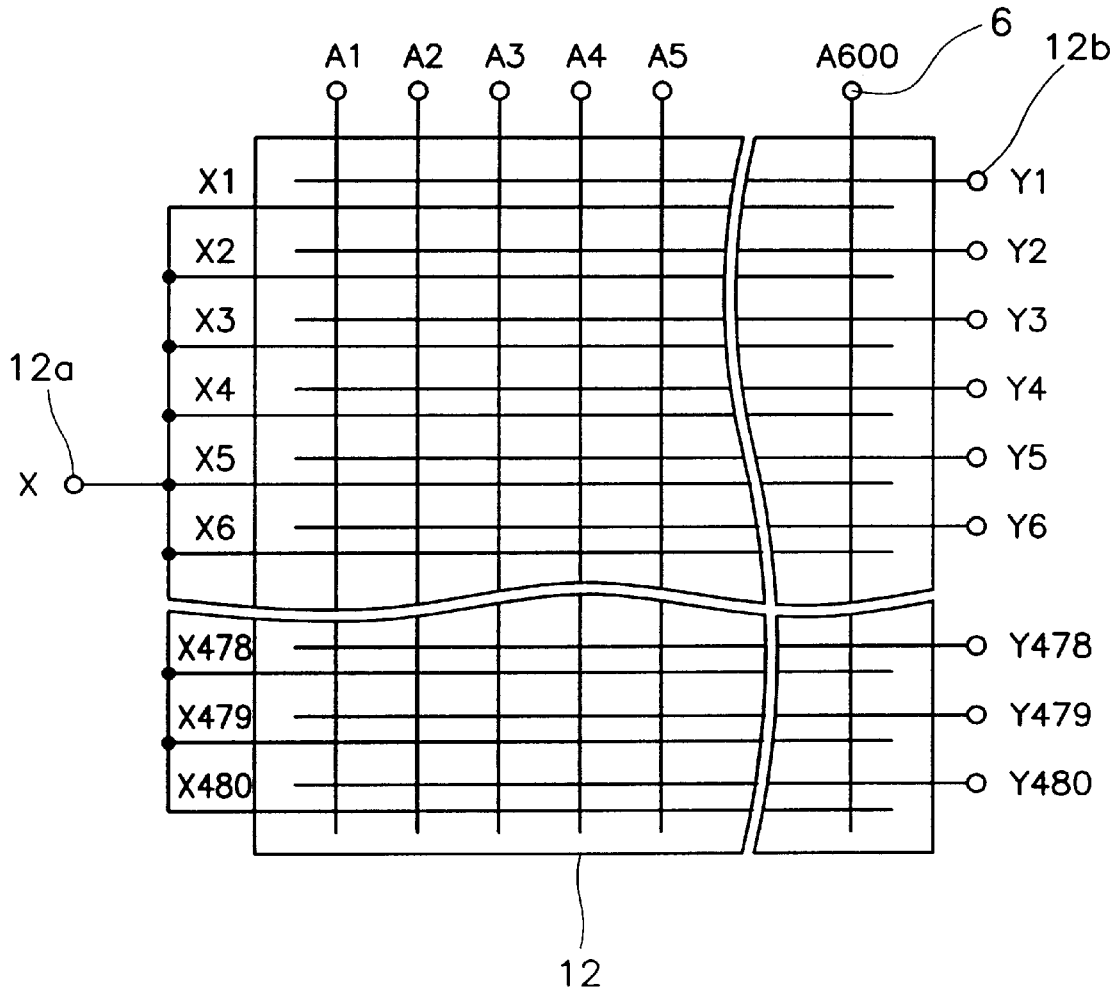
FIG. 4 (PRIOR ART)
FIG. 4 is a layout diagram of the AC three-electrode face discharge PDP shown in FIG. 2, constructed for implementation of the gray scale display method shown in FIG. 3.
Figure 5:
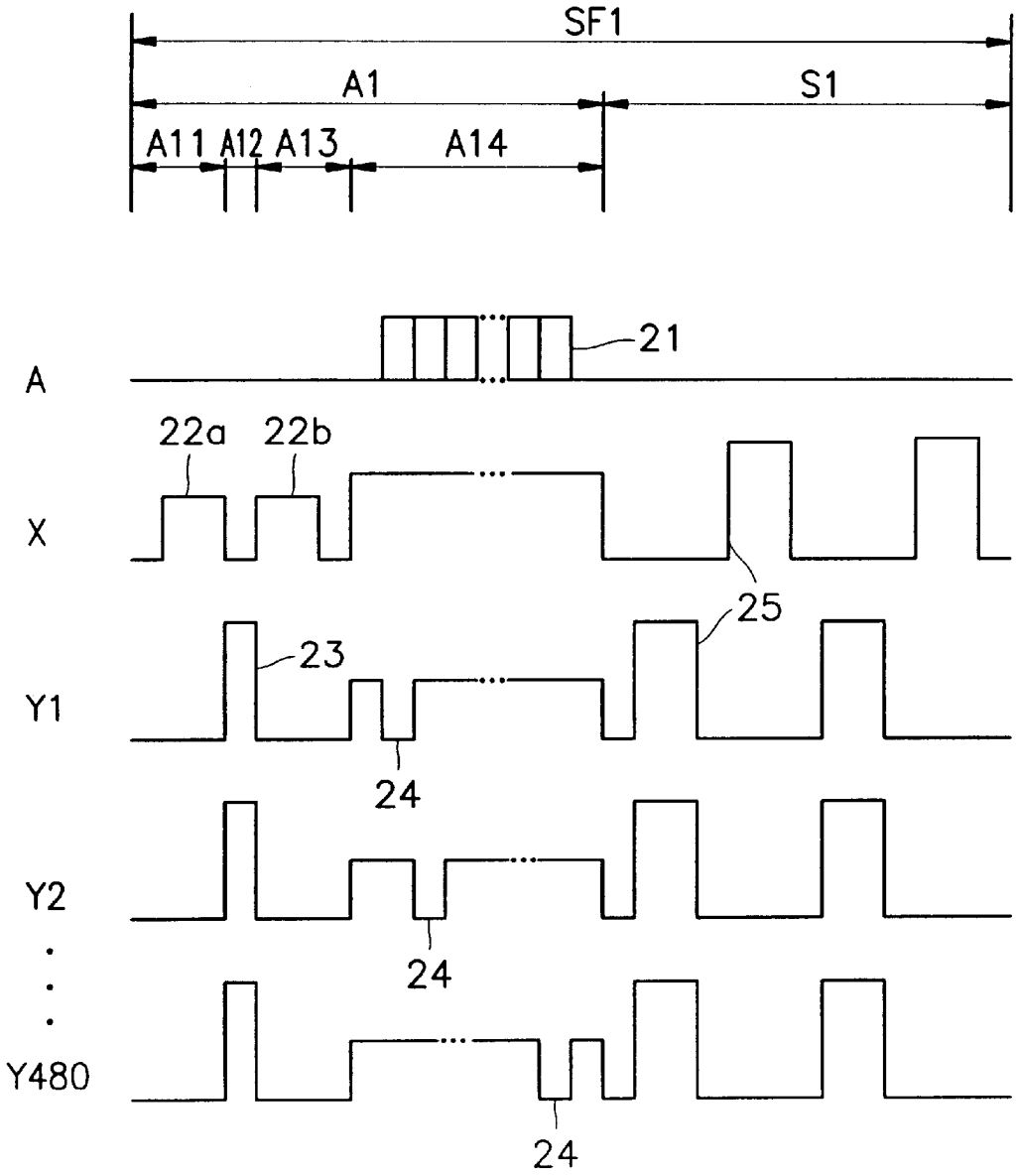
FIG. 5 (PRIOR ART)
FIG. 5 is a diagram showing waveforms of driving signals applied to the respective electrodes shown in FIG. 4.
Figure 6:
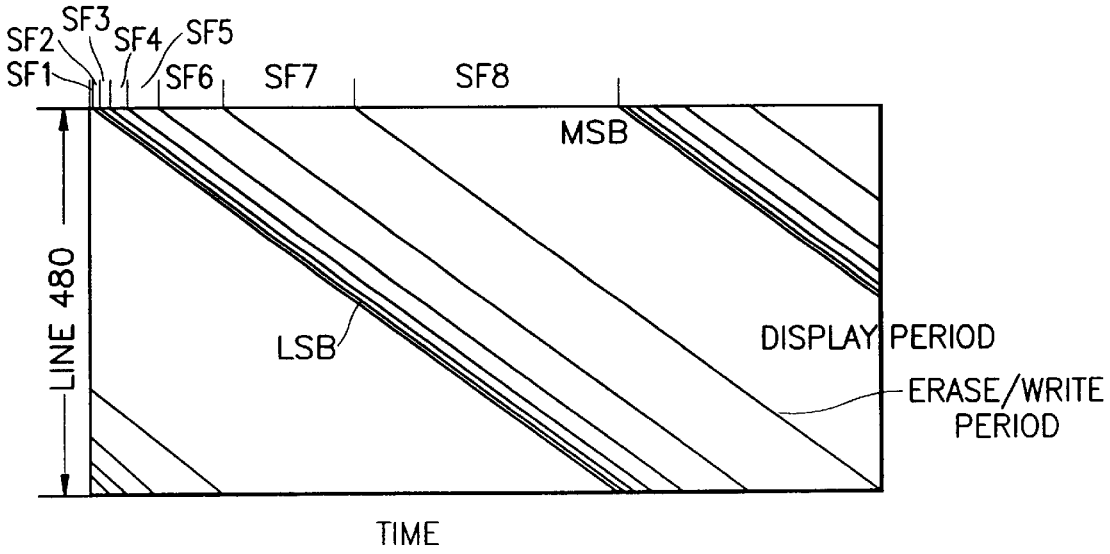
FIG. 6 (PRIOR ART)
FIG. 6 is a timing diagram of a driving signal of a PDP which employs a general address-while-display (AWD) driving method.

For this purpose, according to the AWD driving method shown in FIG. 6, in which a discharge sustain pulse is continuously applied, since discharge sustain pulses of different sub-fields must be applied to different lines, application of discharge sustain pulses cannot be interrupted at discretion. Thus, discharges must be discontinued by applying an erase pulse in the course of a sustained discharge. Here, the erase operation is done using the waveform of one erase pulse for every group of lines constituting a cell at which a discharge occurs. This is because an erase operation cannot be collectively performed on the whole panel, in terms of characteristics of the AWD driving method. The erase pulse applied can be applied to either Y-electrode or X-electrode, and a narrow-width pulse is chiefly used. Also, since the erase pulse used in the present invention is the same as that of a prior art erase period by which the length of each sub-field is determined, it is not necessary to apply another erase pulse waveform for performing an APC function. Also, since the erase period is not required later once an erase pulse for APC is applied, the PDP is easily designed.

As described above, in implementing the AWD driving method in a PDP, the driving signal, which is applied, based on the AWD driving method, to the discharge sustaining electrodes for the purpose of suppressing the power consumption for keeping the screen of the PDP bright, is continuously applied without interruption while the respective frames are all displayed, that is, irrespective of the performance of discharge. In other words, in order to reduce power consumption in implementing the AWD driving method, write and erase operations are performed during the period in which sustained discharge occurs. The novel feature of the AWD driving method lies in that each discharge sustaining pulse is applied without interruption during all sub-field periods.

Also, in order to attain APC using this driving method, there is a need for providing an apparatus capable of adjusting the lighting number in each sub-field without interrupting the application of each discharge sustain pulse allocated to the PDP, by adjusting the position at which the erase pulse is written.

Figure 7:
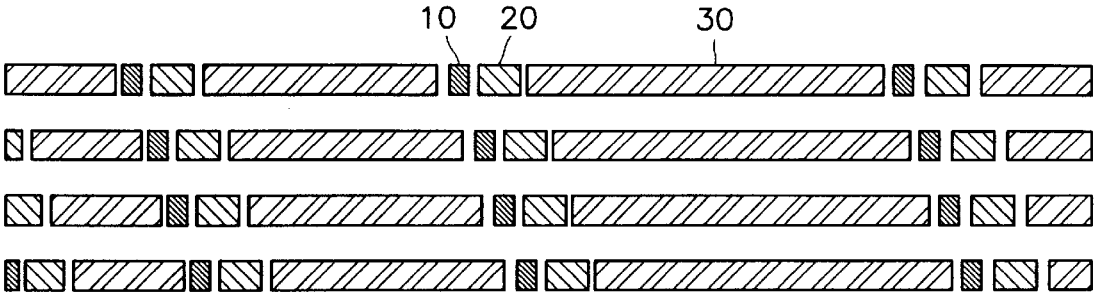
FIG. 7 (PRIOR ART)
FIG. 7 is a partially enlarged timing diagram based on the AWD driving method shown in FIG. 6.

FIG. 7 is an enlargement of a portion of the timing diagram of waveforms based on the AWD driving method shown in FIG. 6. As shown, when a screen is normally displayed, an erase period 10, an address period 20 and a sustained discharge period 30 have different timing. In this case, when a large-sized screen is maintained in a bright state, power consumption increases, which causes the above-described problems.

Figure 8:
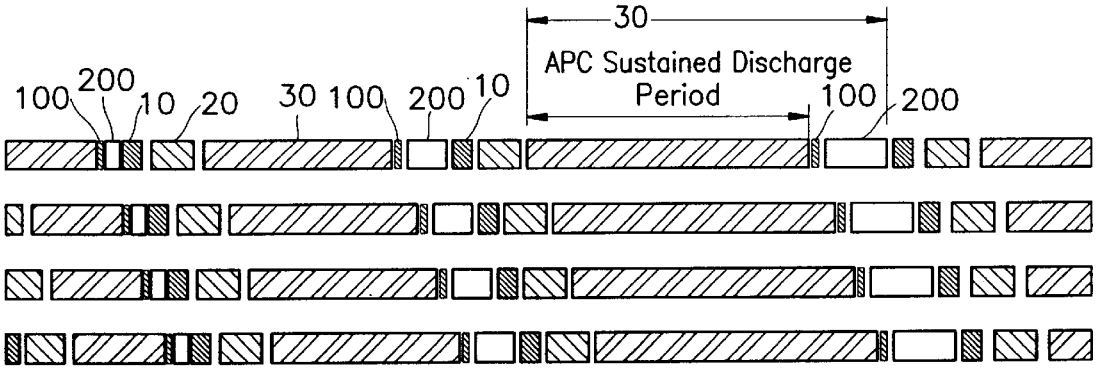
FIG. 8 is a timing diagram of a driving signal based on a PDP driving method according to an embodiment of the present invention having an automatic power control (APC) function.

To avoid this, in the PDP driving method capable of APC according to the present invention, as shown in FIG. 8, a new erase period 100 is inserted into a sustained discharge period 30. The newly inserted erase period 100 interrupts lighting of discharge sustain pulses applied during the latter stage of the sustained discharge period 30 of each sub-field. In such a manner, the length of the sustained discharge period of each sub-field can be adjusted, thereby suppressing power consumption. In FIG. 8, the sustained discharge period is shown as APC sustained discharge period. The discharge sustain pulses applied after the APC sustained discharge period cannot cause a sustained discharge because wall charges are erased by the erase pulse 100 applied for reducing power consumption. Thus, quiescent periods 200 are produced. Since a sustained discharge does not occur during a period corresponding to the quiescent period 200 of the original sustained discharge period 30, the luminance decreases accordingly, thereby reducing power consumption.

Figure 9:
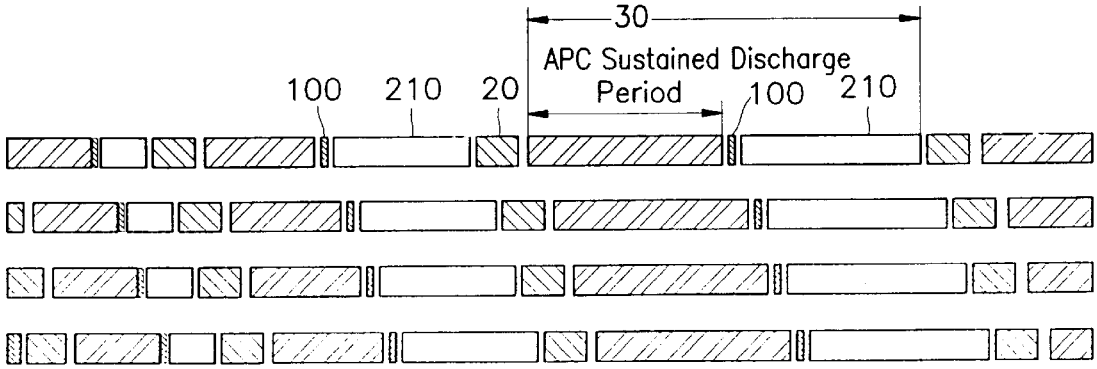
FIG. 9 is a timing diagram of a driving signal based on a PDP driving method according to another embodiment of the present invention having an APC function.

Also, as shown in FIG. 8, if a new quiescent period 100 is produced by a newly applied erase pulse, the erase pulse applied during the original erase period 10 is meaningless. Thus, after the new erase pulse is applied during the erase period 100 for APC, as shown in FIG. 9, an erase pulse for forming the original erase period 10 is not necessarily applied. Thus, an address operation (during the address period 20) may be performed immediately after the quiescent period 210 for reducing power consumption. In other words, application of the meaningless erase pulse 10 is not performed, thereby further reducing power consumption and simplifying the operation of the PDP. FIG. 9 shows that about 50% of the period allocated for the overall sustained discharge is set as a non-lighting period.

Figure 10A:
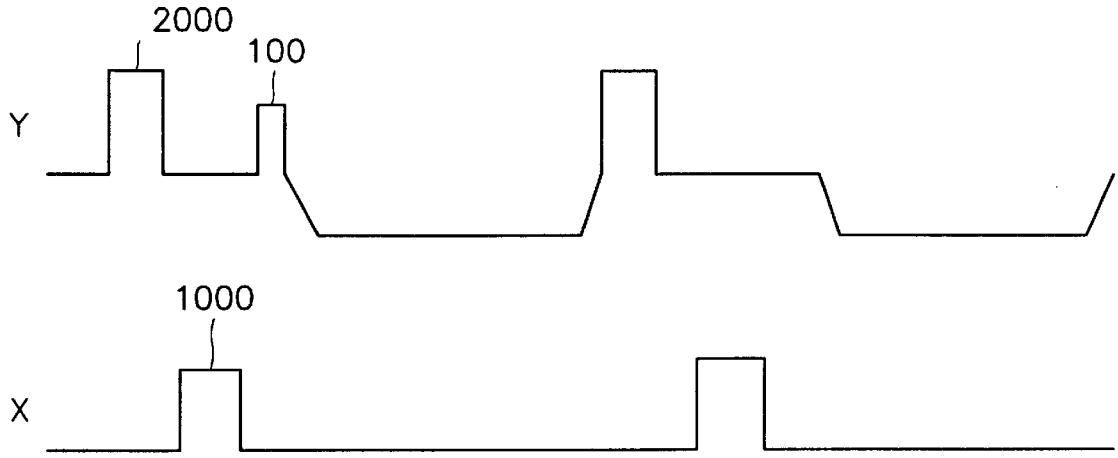
FIGS. 10A and 10B show waveforms according to a first example of an erase pulse applied to discharge sustaining electrodes during sustained discharge periods shown in FIG. 8 or 9.
Figure 10B:
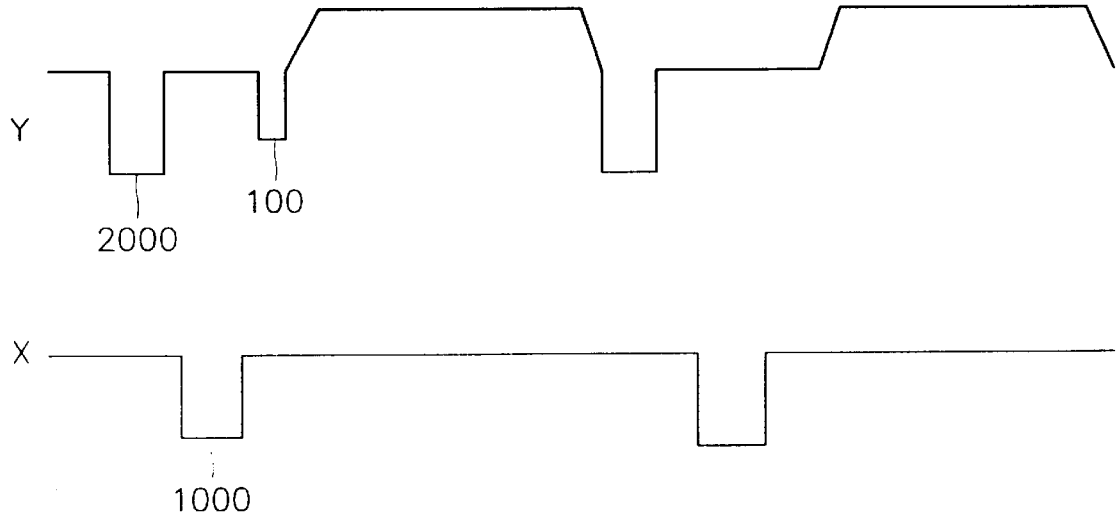

FIGS. 10A and 10B are detailed waveform diagrams of driving voltages applied to discharge sustaining electrodes, illustrating erase operations at erase periods. As shown in the drawings, an erase pulse 100 has the same polarity as the discharge sustain pulse 2000 applied to a Y-electrode (a scanning line) and is applied immediately after applying a discharge sustain pulse 1000 to an X-electrode. The erase pulse 100 has a width narrower than that of a discharge sustain pulse 2000 applied to the Y-electrode and functions to erase wall charges formed by the discharge sustain pulse 1000 applied to the X-electrode. FIGS. 10A and 10B show waveforms of driving signals having voltage pulses of opposite polarities.

In view of the pulses used in the present invention, short periods into which erase pulses can be inserted have been provided in advance, even in the periods during which erase pulses not applied, so that an erase pulse can be applied to any one of the scanning lines.

Figure 11A:
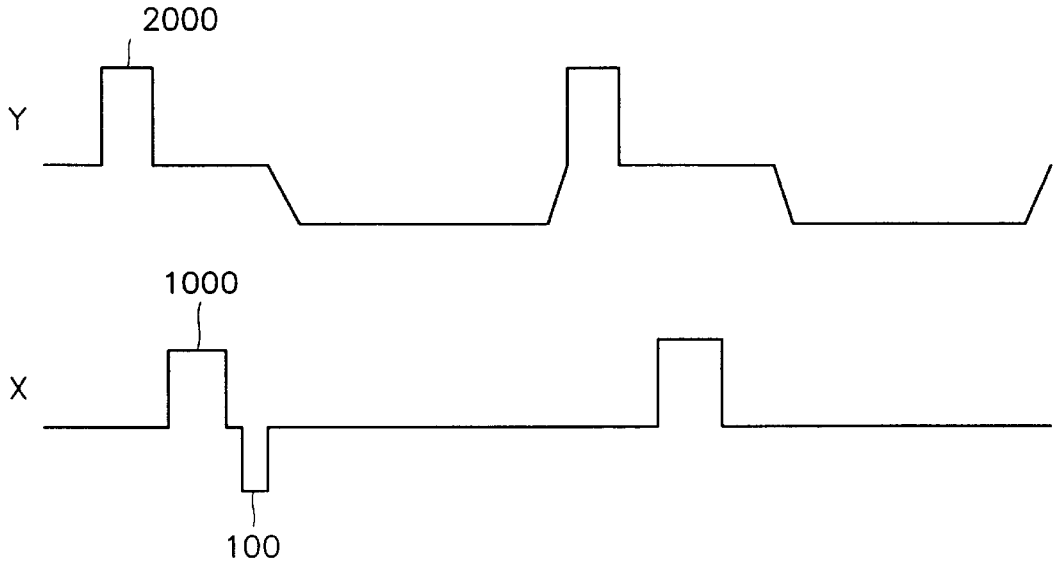
FIGS. 11A and 11B show waveforms according to a second example of the erase pulse shown in FIG. 10.
Figure 11B:
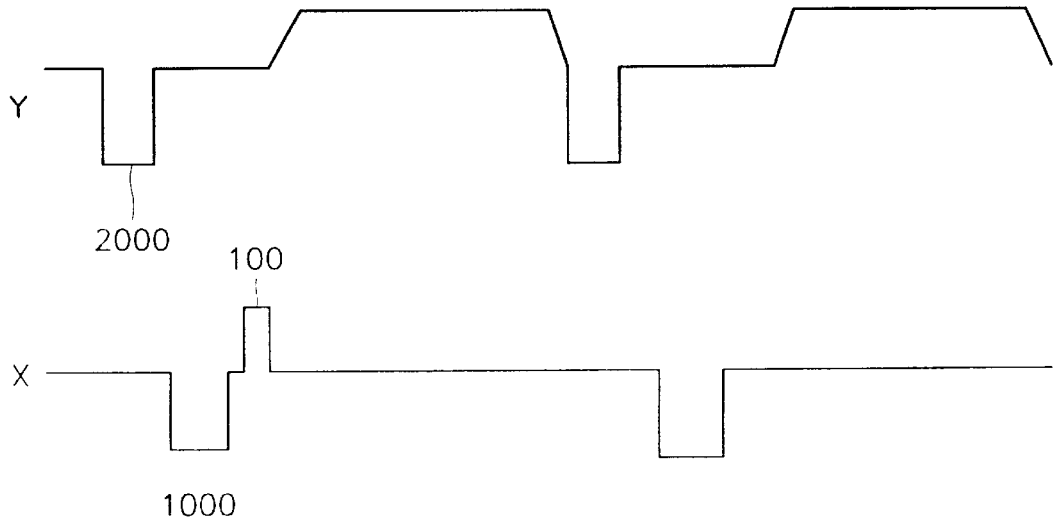

FIGS. 11A and 11B are waveform diagrams based on another example of an erase pulse. In FIG. 11A, an erase pulse 100 has a polarity opposite to that of a discharge sustain pulse 1000, i.e., a negative polarity, and is applied to an X-electrode immediately after applying the discharge sustain pulse 1000 thereto. The erase pulse 100 has a width narrower than that of the discharge sustain pulse 1000. The erase pulse 100 functions to erase wall charges formed by the discharge sustain pulse 1000 applied to the X-electrode in the immediately preceding step. FIGS. 11A and 11B show waveforms of driving signals having voltage pulses of opposite polarities.

Figure 12A:
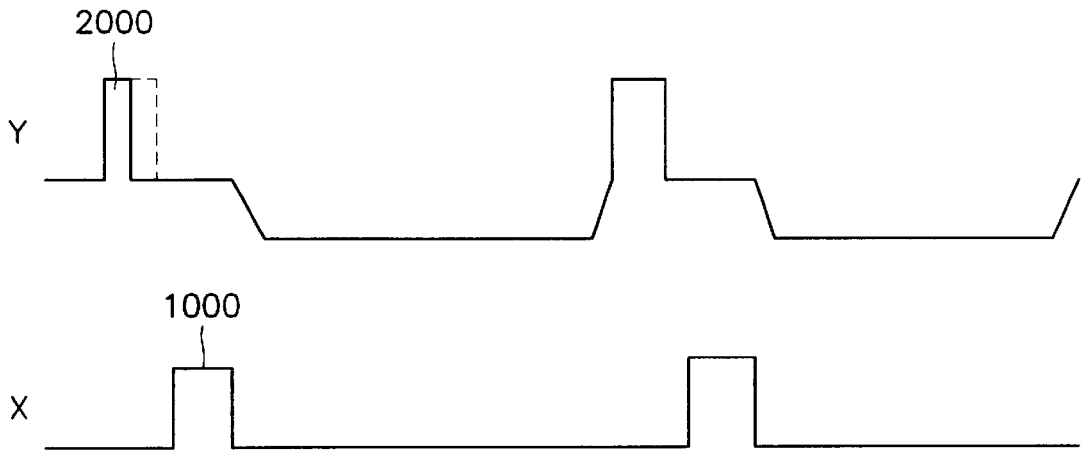
FIGS. 12A and 12B show waveforms according to a third example of the erase pulse shown in FIG. 10.
Figure 12B:
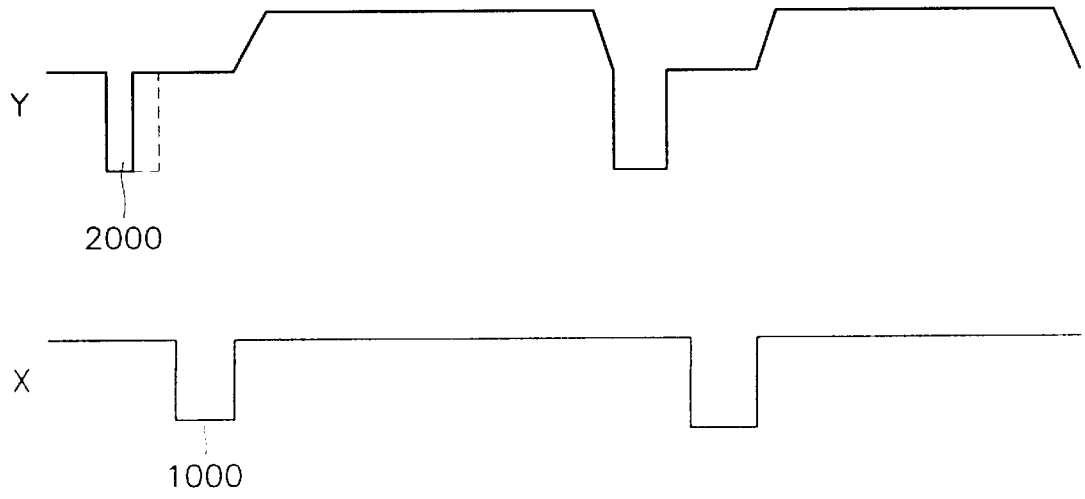

FIGS. 12A and 12B show an example of an erasing method of performing an erase operation using a time during which a discharge sustain pulse 2000 is applied, in a state where a time for an erase pulse is not allocated. In FIGS. 12A and 12B, in order to perform an erase operation, the width of a discharge sustain pulse 2000 applied to the Y-electrode during a sustained discharge period is adjusted to be narrow. As shown in the drawings, the width of the pulse 2000 applied to the Y-electrode is decreased, so that the narrow-width pulse serves to erase wall charges formed by the previous discharge sustain pulse. FIGS. 12A and 12B show waveforms of driving signals having voltage pulses of opposite polarities.

Figure 13A:
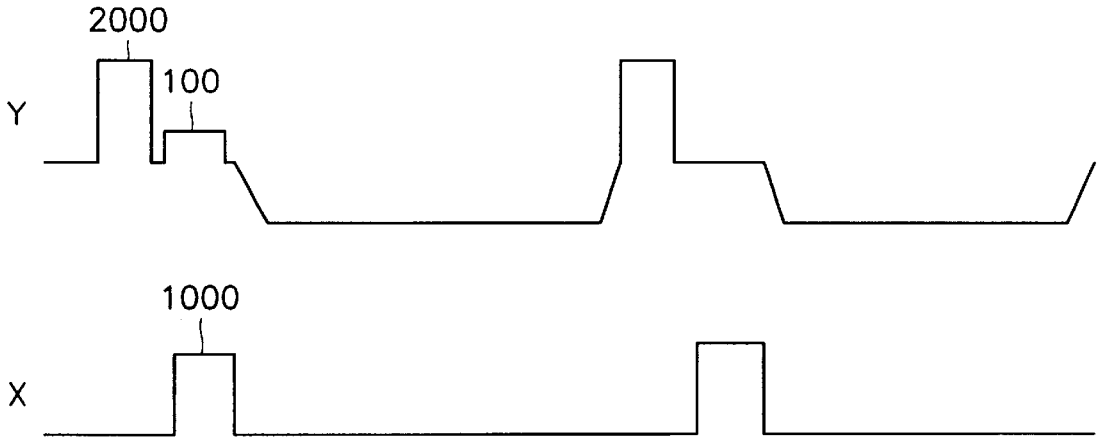
FIGS. 13A and 13B show waveforms according to a fourth example of the erase pulse shown in FIG. 10.
Figure 13B:
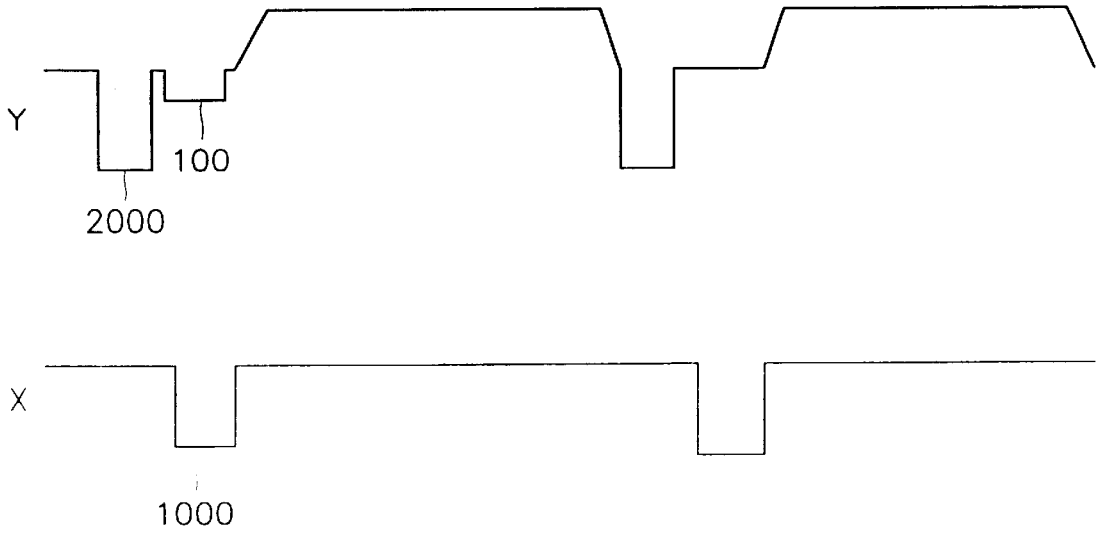

FIGS. 13A and 13B show another example of an erasing method of performing an erase operation using a time during which a discharge sustain pulse is applied, in a state where a time for application of an erase pulse is not allocated. In FIGS. 13A and 13B, a pulse 100 having a voltage lower than that of the sustain pulse 1000 applied to the X-electrode, is applied to the Y-electrode in synchronization with the discharge sustain pulse 1000, to weaken the electrical field formed between the corresponding lines, thereby erasing wall charges formed by the previous discharge sustain pulse. FIGS. 13A and 13B show waveforms of driving signals having voltage pulses of opposite polarities.

Figure 14A:
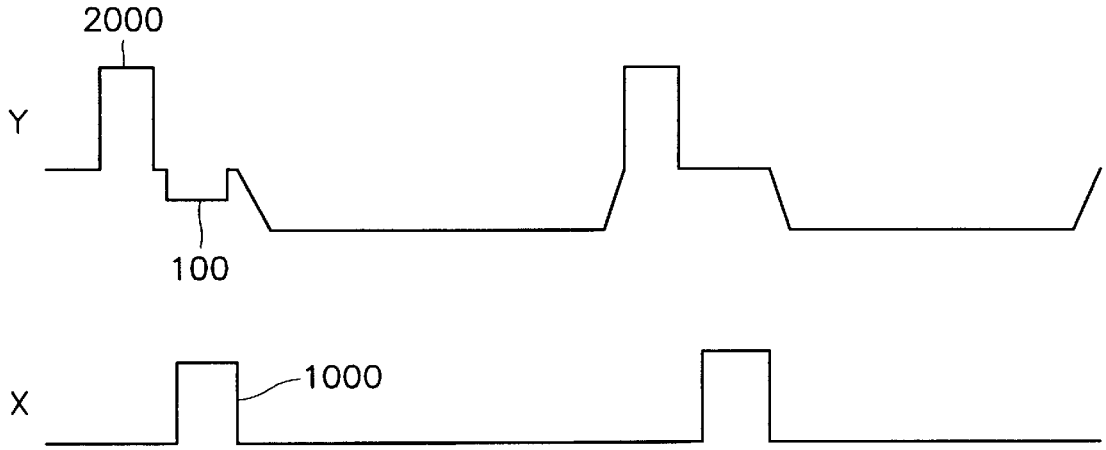
FIGS. 14A and 14B show waveforms according to a fifth example of the erase pulse shown in FIG. 10.
Figure 14B:
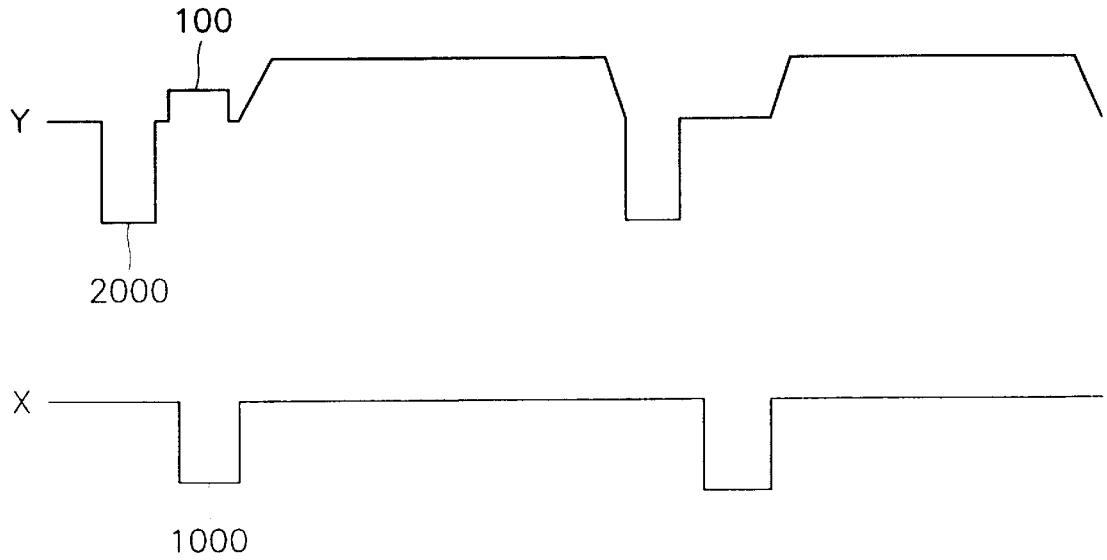

FIGS. 14A and 14B show still another example of an erasing method of performing an erase operation using a time during which a discharge sustain pulse is applied, in a state where a time for application of an erase pulse is not allocated. In FIGS. 14A and 14B, a pulse 100 having a voltage of the opposite polarity to that of the discharge sustain pulse 2000 applied to the Y-electrode, is applied to the Y-electrode in synchronization with the discharge sustain pulse 1000 applied to the X-electrode, to cause a discharge between the X-electrode and the Y-electrode. Here, the voltage applied to the X-electrode is the same as the discharge sustain pulse voltage. Also, the voltage applied to the Y-electrode is higher than or equal to the difference between the discharge sustain pulse voltage and a discharge starting voltage, which is because the applied voltage must be high enough to cause a discharge, irrespective of whether a cell is at an ON or OFF state. FIGS. 14A and 14B show waveforms of driving signals having voltage pulses of opposite polarities.

Figure 15:
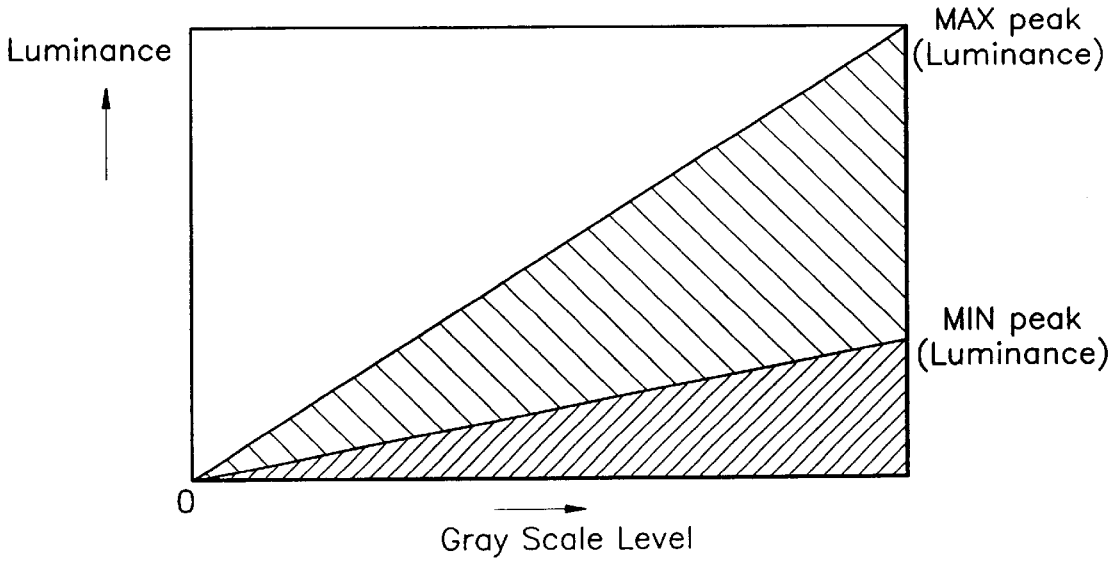
FIG. 15 is a graph showing the luminance relative to gray scale level based on the PDP driving method having an APC function shown in FIG. 8 or 9.

FIG. 15 is a graph showing the luminance output in proportion to gray scale levels, in which the horizontal axis indicates the number of expressible gray scale levels, and the vertical axis indicates the luminance allocated for each gray scale level. The maximum peak of the luminance represents the maximum luminance that can be exhibited based on the AWD driving method, as designed. However, in the case where the luminance having the maximum peak is continuously exhibited, power consumption increases due to a large number of discharges and the service life of a PDP is reduced. Thus, if a power-consuming bright screen is continuously displayed, it is necessary to forcibly reduce the luminance peak to a level between the maximum peak and the minimum peak. In this case, in order to properly display the luminance for each gray scale level, the number of discharge sustain pulses applied at each sub-field must be reduced in proportion to the gray scale level of the corresponding sub-field. To this end, it is desirable to proportionately change the positions of application of the above-described erase pulses for each sub-field, which will now be described in detail.

In other words, in the case of a PDP for displaying 256 (that is, $2^8$) gray scales, one frame has 8 sub-fields. Thus, the gray scale levels of the respective sub-fields are expressed in a ratio of 1:2:4:8:16:32:64. For example, if 5 discharge sustain pulses are applied to a sub-field whose gray scale level is 1, the numbers of discharge sustain pulses applied to the respective sub-fields comply with a ratio of 5:10:20:40:80:160:320:640. Here, if a discharge sustain pulse is invalidated at a sub-field whose gray scale level is 1 using an erase pulse, discharge sustain pulses whose number ration is 2:4:8:16:32:64:128 are invalidated using erase pulses. Finally, the numbers of effective discharge sustain pulses at the respective sub-fields are 4, 8, 16, 32, 64, 128, 256 and 512, respectively. Also, if two discharge sustain pulses are invalidated using erase pulses at a sub-field whose gray scale level is 1, then 4, 8, 16, 32, 64, 128 and 256 discharge sustain pulses are invalidated at the respective sub-fields by erase pulses, and the numbers of effective discharge sustain pulses at the respective sub-fields are 3, 6, 12, 24, 48, 96, 192 and 384, respectively. Thus, as shown in FIG. 15, the graph of the luminance relative to the respective gray scale levels has a constant slope. Alternatively, utilizing the fact that pictures of high luminance are not perceptible by the human eye, an erase pulse is preferably applied such that the slope becomes rather gentle at the high luminance side of the graph shown in FIG. 15. To this end, the timing of erase pulses applied during sustained discharge periods is adjusted such that the ratio of the number of invalidated discharge sustain pulses is smaller than the ratio of the lengths of sustained discharge periods of the corresponding sub-field at a sub-field having a longer display period.

Thus, in the AWD driving method in which the number of discharges is greater than that in the ADS driving method, the service life of a PDP can be prolonged and power consumption can be reduced.

Figure 16:
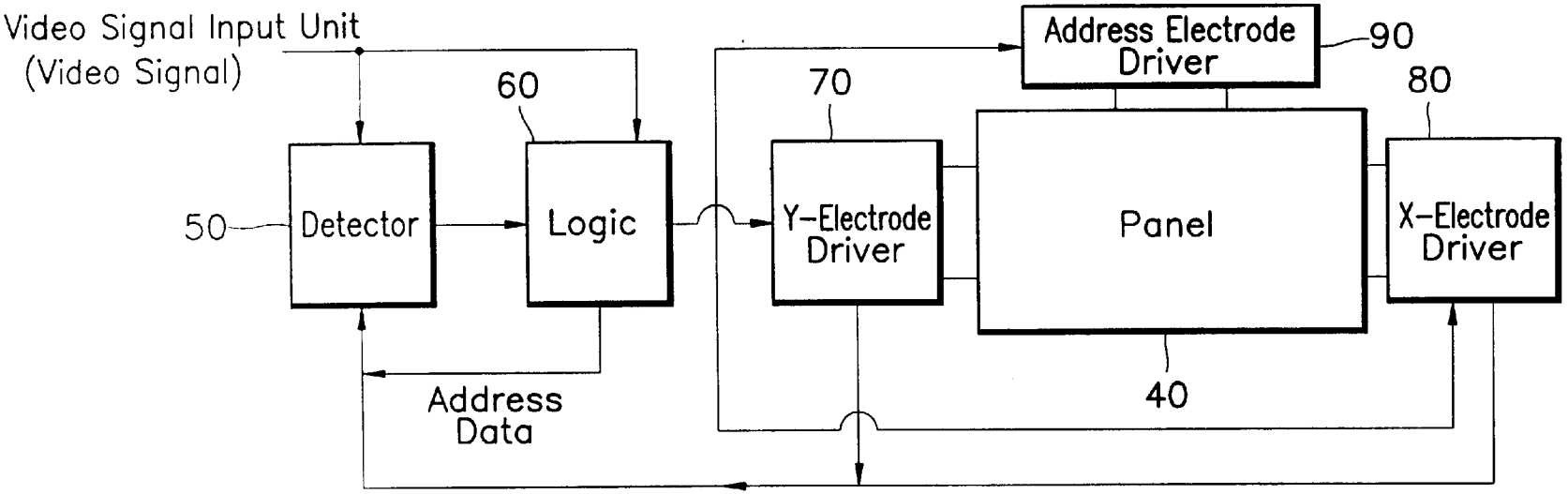
FIG. 16 is a schematic block diagram of a PDP for implementing the PDP driving method having an APC function according to the present invention.

FIG. 16 is a schematic block diagram of a PDP driving apparatus for implementing a driving method of a PDP with an APC function according to the present invention. As shown in FIG. 16, the PDP driving apparatus includes a detector 50, a logic unit 60, an X-electrode driver 80 and a Y-electrode driver 70 for driving X- and Y-electrodes of a panel 40, and an address electrode driver 90 for driving address electrodes. The detector 50 detects the brightness of a picture using a video signal (analog or digital) supplied from a video signal input unit, address data supplied from the logic unit 60 for reproducing the video signal, and the amount of power supplied from the drivers 70, 80 and 90 to the panel 40. The logic unit 60 receives one or more signals detected by the detector 50 and compares them with data of a previously prepared reference table to generate a signal for determining the position of a newly applied erase pulse or for changing the position of the previously applied erase pulse. Using the generated signal, the X- and Y-electrode drivers 80 and 70 shift the positions of previous erase pulses in a direction in which the lighting number due to sustained discharges increases or decreases, or applies a new erase pulse to a selected position, thereby obstructing further performance of lighting due to sustained discharges.

As described above, according to the method of the present invention for driving a PDP with an APC function, in implementing the AWD driving method for an AC three electrode PDP, in order to suppress power consumption required for maintaining a bright state of the screen, discharge sustain pulses at respective sub-fields for implementing gray scale display of each frame are invalidated using erase pulses in a constant ratio for each sub-field, while all the video signals applied in the form of the AWD driving waveforms are continuously applied to the respective frame periods in which all the video signals are displayed without interruption, that is, irrespective of whether discharge is performed or not. Thus, while attaining improvement in the luminance by applying many discharge sustain pulses based on the AWD driving method, the power consumption conventionally required to maintain high luminance can be automatically reduced. This method is specifically advantageously used for effectively controlling the power consumed during periods in which a bright image is continuously displayed. This method is characterized in that an erase pulse is applied to locations at which a difference in the luminance between the respective sub-fields is produced. In particular, the locations of the erase pulse may be alternately changed into a location at which the luminance is maximum or a location at which the luminance is minimum. Here, while keeping the erase ratio in each sub-field not to reduce the capacity of each sub-field to display gray scales, the overall gray scale luminance is controlled to be between the maximum luminance and the minimum luminance, thereby suppressing the excess power consumption.

What is claimed is:

1. A method for driving a plasma display panel (PDP) with an automatic power control function, the PDP having discharge sustaining electrodes including pairs of scanning lines and common lines, and address electrodes arranged orthogonally to the discharge sustaining electrodes, the discharge sustaining and address electrodes being driven by an address-while-display (AWD) driving method in which addressing and sustaining discharges for expressing gray scale levels by sub-fields, each sub-field consisting of an erase period, an address period, and a sustained discharge period, are simultaneously performed at the scanning lines, not in a time-division manner, to display a video signal of each frame on the PDP, the method comprising:

before applying erase pulses at timing points during the sustained discharge periods, determining application timing points of the erase pulses by obtaining an invalidation ratio of discharge sustain pulses applied to the respective sub-fields by detecting power consumed at a power source stage for driving the PDP when luminance is at a maximum; and applying the erase pulses for invalidating some discharge sustain pulses applied during the sustained discharge periods corresponding to respective sub-fields so as not to cause a sustained discharge, at timing points during the sustained discharge periods of the respective sub-fields.

2. The method according to claim 1, including applying erase pulses having the same polarity as the discharge sustain pulses applied to the scanning lines to the scanning lines immediately after application of the discharge sustain pulses to the common lines, the erase pulses having widths narrower than the discharge sustain pulses.

3. The method according to claim 1, including applying erase pulses having the opposite polarity from the discharge sustain pulses applied to the common lines to the common lines immediately after application of the discharge sustain pulses to the common lines, the erase pulses having widths narrower than the discharge sustain pulses.

4. The method according to claim 1, wherein the discharge sustained pulses applied to the scanning lines and to the common lines have respective widths and including forming erase pulses by reducing the width of one of the discharge sustain pulses applied to the scanning lines so that the width reduced is narrower than the widths of the discharge sustain pulses applied to the common lines.

5. The method according to claim 1, including forming the erase pulses by applying voltages lower than the discharge sustain pulses applied to the common lines, to the scanning lines in synchronization with the discharge sustain pulses applied to the common lines.

6. The method according to claim 1, including forming the erase pulses by applying pulse voltages having the opposite polarity from the discharge sustain pulses applied to the scanning lines, in synchronization with the discharge sustain pulses applied to the common lines.

7. The method according to claim 6, wherein each erase pulse has a voltage at least equal to the difference between a discharge starting voltage and the voltage of each of the discharge sustain pulses applied to the common lines.

8. The method according to claim 1, including determining the timing point for application of the erase pulse during the sustained discharge period by a constant time ratio that is proportional to periods of respective sub-fields.

9. A method for driving a plasma display panel (PDP) with an automatic power control function, the PDP having discharge sustaining electrodes including pairs of scanning lines and common lines, and address electrodes arranged orthogonally to the discharge sustaining electrodes, the discharge sustaining and address electrodes being driven by an address-while-display (AWD) driving method in which addressing and sustaining discharges for expressing gray scale levels by sub-fields, each sub-field consisting of an erase period, an address period, and a sustained discharge period, are simultaneously performed at the scanning lines, not in a time-division manner, to display a video signal of each frame on the PDP, the method comprising:

before changing application timing points of erase pulses and applying the erase pulses, determining the application timing points of the erase pulses during the sustained discharge periods of respective sub-fields by obtaining an invalidation ratio of discharge sustain pulses applied to the respective sub-fields by detecting power consumed at a power source stage for driving the PDP when luminance is at a maximum; and changing the timing points of the application of the erase pulses into timing points during the sustained discharge periods of respective sub-fields, and applying the erase pulses during the sustained discharge periods, the erase pulses being applied for invalidating some discharge sustain pulses applied during the sustained discharge periods corresponding to respective sub-fields so as not to cause a sustained discharge.

10. The method according to claim 9, including applying erase pulses having the same polarity as the discharge sustain pulses applied to the scanning lines to the scanning lines immediately after application of the discharge sustain pulses to the common lines, the erase pulses having widths narrower than the discharge sustain pulses.

11. The method according to claim 9, including applying erase pulses having the opposite polarity from the discharge sustain pulses applied to the common lines to the common lines immediately after application of the discharge sustain pulses to the common lines, the erase pulses having widths narrower than the discharge sustain pulses.

12. The method according to claim 9, wherein the discharge sustained pulses applied to the scanning lines and to the common lines have respective widths and including forming erase pulses by reducing the width of one of the discharge sustain pulses applied to the scanning lines so that the width reduced is narrower than the widths of the discharge sustain pulses applied to the common lines.

13. The method according to claim 9, including forming the erase pulses by applying voltages lower than the discharge sustain pulses applied to the common lines, to the scanning lines in synchronization with the discharge sustain pulses applied to the common lines.

14. The method according to claim 9, including forming the erase pulses by applying pulse voltages having the opposite polarity from the discharge sustain pulses applied to the scanning lines, in synchronization with the discharge sustain pulses applied to the common lines.

15. The method according to claim 14, wherein each erase pulse has a voltage at least equal to the difference between a discharge starting voltage and the voltage of each of the discharge sustain pulses applied to the common lines.

16. The method according to claim 9, including determining the timing point for applying the erase pulse during the sustained discharge period by a constant time ratio that is proportional to periods of respective sub-fields.

* * * * *